US007582047B2

(12) United States Patent
Madson

(10) Patent No.: US 7,582,047 B2
(45) Date of Patent: Sep. 1, 2009

(54) FOLDABLE UTILITY RECEPTACLE AND METHOD

(75) Inventor: Craig J. Madson, Farmington, UT (US)

(73) Assignee: Madson Products, LLC, Farmington, UT (US)

( * ) Notice: Subject to any disclaimer, the term of this patent is extended or adjusted under 35 U.S.C. 154(b) by 0 days.

(21) Appl. No.: 12/015,863

(22) Filed: Jan. 17, 2008

(65) Prior Publication Data

US 2008/0182739 A1 Jul. 31, 2008

Related U.S. Application Data

(62) Division of application No. 11/400,350, filed on Apr. 7, 2006, now Pat. No. 7,344,022.

(51) Int. Cl.
*B31B 1/90* (2006.01)

(52) U.S. Cl. ..... 493/214; 206/226; 383/89

(58) Field of Classification Search ..... 493/214, 493/409, 440; 383/2, 88, 89, 90, 210.1; 220/495.11; 206/205, 226, 570, 803
See application file for complete search history.

(56) References Cited

U.S. PATENT DOCUMENTS

| | | | | |
|---|---|---|---|---|
| 2,648,263 | A | 8/1953 | Richens | |
| 2,943,660 | A | 7/1960 | Seeger | |
| 3,149,771 | A | 9/1964 | Pearl | |
| 3,575,225 | A | 4/1971 | Muheim | |
| 3,797,734 | A | 3/1974 | Fleury et al. | |
| 3,920,179 | A | 11/1975 | Hall | |
| 4,182,478 | A | 1/1980 | Etes | |
| 4,328,895 | A | 5/1982 | Jaeger | |
| 4,501,780 | A | 2/1985 | Walters et al. | |
| 4,537,189 | A | 8/1985 | Vicenzi | |
| 4,566,607 | A | 1/1986 | Smith | |
| 4,610,039 | A | 9/1986 | Stern | |
| 4,706,297 | A | 11/1987 | Ausnit | |
| 4,917,238 | A | 4/1990 | Schumacher | |
| 5,599,332 | A | 2/1997 | Cashel | |
| 5,745,926 | A | 5/1998 | Cailleteau | |
| 5,788,378 | A | 8/1998 | Thomas | |
| 5,855,435 | A * | 1/1999 | Chiesa | 383/204 |
| 5,857,586 | A | 1/1999 | Scherr | |
| 5,887,942 | A | 3/1999 | Allegro, Jr. | |
| 5,950,818 | A | 9/1999 | Paulsen | |
| 5,971,969 | A | 10/1999 | Cashel | |

(Continued)

FOREIGN PATENT DOCUMENTS

| | | |
|---|---|---|
| CA | 2101483 | 1/1995 |

(Continued)

*Primary Examiner*—Thanh K Truong
(74) *Attorney, Agent, or Firm*—Madson IP, P.C.

(57) ABSTRACT

A receptacle that is foldable between its open mode for receiving material and a secured mode where its top is double folded and secured with fasteners for maintaining material within the receptacle, or the receptacle is foldable between its open mode and a storage mode when the receptacle is folded to align releasable fasteners and to create a pass-through pocket for receiving accessories. In the storage mode, the receptacle can easily be carried in a pocket or purse until needed to receive undesirable material for disposal. The receptacle can be unfolded from the storage mode to the open mode to receive material.

8 Claims, 8 Drawing Sheets

U.S. PATENT DOCUMENTS

| | | | |
|---|---|---|---|
| 6,045,170 | A | 4/2000 | Allen |
| 6,189,162 | B1 | 2/2001 | Tanner |
| 6,210,382 | B1 | 4/2001 | Hogg |
| 6,345,911 | B1 | 2/2002 | Young et al. |
| 6,554,810 | B1 | 4/2003 | Wilk et al. |
| 6,589,220 | B2 | 7/2003 | Taylor |
| 6,991,373 | B2 | 1/2006 | Carr et al. |
| 7,041,042 | B2 | 5/2006 | Chertkow et al. |
| 2003/0031763 | A1 | 2/2003 | Inagaki et al. |
| 2004/0001653 | A1 | 1/2004 | Carr et al. |
| 2005/0127087 | A1 | 6/2005 | Clark et al. |

FOREIGN PATENT DOCUMENTS

| | | |
|---|---|---|
| FR | 2 866 230 | 8/2005 |

* cited by examiner

FOLDABLE UTILITY RECEPTACLE AND METHOD

RELATED APPLICATIONS

This application is a divisional of U.S. patent application Ser. No. 11/400,350, filed Apr. 7, 2006 and now issued as U.S. Pat. No. 7,344,022, which is incorporated herein by reference.

BACKGROUND OF THE INVENTION

This invention relates generally to utility bags used for motion sickness and disposal of unpleasant matter. More specifically, the present invention relates to a utility receptacle that can be sealed for disposal and can be folded for storage using a common fastener.

Various types of emesis receptacles used in hospitals and healthcare facilities are known. Such receptacles are sophisticated and expensive. Also, air sickness bags are commonly known. They are provided by airlines for use by passengers that experience the discomfort of air sickness. Once used, they are sealed and typically presented to a flight attendant for disposal.

Emesis, or contents of the stomach when eliminated by reflux through the esophagus, is a noxious substance whose collection and disposal in institutional settings is an unpleasant reality. In addition to causing more or less unpleasant sensations in those charged with its handling, emesis is or is perceived to be an agent of transmission of potentially harmful biological agents. It may contain bacteria or toxins implicated in food poisoning, and in some patients may also contain blood, with an associated risk of blood-borne pathogens. Therefore there is a demand for products which permit a neat containment of emesis and minimize a possibility of exposure to others.

Impermeable paper bags or plastic bags known as "air-sickness" bags have been provided with various types of closures. Integral metal twist closures, adhesive strips or tabs, and zip-lock seals are known. While compact and inexpensive, these bags have become increasingly less available as airlines cut back on expenses. Additionally, known air-sickness bags have limited versatility.

Larger, more robust, rigid plastic containers are known. The containers may be provided with a screw on cap to be installed after use, and internal baffles or splash guards, which also function to limit spillage in an event an uncapped used container is inadvertently laid on a side or upended. These rigid containers, while superior to simple air-sickness bags in preventing spillage, require a significant mount of storage space because of their rigidity and are even less versatile than the simple air-sickness bag.

The versatility of the air-sickness bag is affected by the means for closing the bag and the typical size of the bag. A variety of fasteners have been used to seal air-sickness bags after use. They range from just folding the open end top of the bag over, or double-folding the top of the bag over to securing the closure using adhesive tape or an integral metal twist closure. Although air-sickness bags are much more compact than institutional emesis containers, they are still larger than what most people are willing to carry in a purse or pocket.

Certainly, if an air-sickness bag could be made more compact and readily available, many other uses for the bag would become apparent, rendering it much more versatile. Such a versatile bag could be a utility bag with many uses and many applications. For example, a more versatile utility bag could be used for the usual air-sickness, but also for morning sickness, nosebleeds, disposal of feminine hygiene products, as an emergency ice pack, as a bag to deal with hyperventilation, or for the disposal of unpleasant material such as dirty diapers, dog excrement, sticky candy, melting ice cream, soiled tissues, or garbage. It would be advantageous to keep such a utility bag in a car glove compartment, in a carry-on bag, in a diaper bag, in a purse, in a gym bag, in a nightstand, in a first aid kit, on a boat, in an RV, in a kit used for comfort on a cruise, or in a pocket while camping, hiking or at an amusement park.

Hence, it would be advantageous to have a utility bag that is versatile enough to be stored in a non-conspicuous manner in a number of places making it available for a number of possible uses.

Further, it would be advantageous to have a utility bag that is inexpensive enough that users could afford to place utility bags in numerous locations for use in the event of need.

It would also be advantageous to have a utility bag that can be folded to form a pass-through pocket within which various accessories can be disposed, accessories such as a moist towelette package, a packet containing medication or motion sickness pills, a doggie pooper scooper, protective gloves, facial tissues and/or any other small accessory that may assist with the use of the utility bag.

Additionally, it would be advantageous to have a utility bag that could be contained within a relatively small package as a specific purpose kit including various items used for a particular use such as a pooper scooper, a moist towelette, and protective gloves for a doggie poop disposal kit, or motion sickness pills or patches, a moist towelette, and protective gloves for a flight or cruise kit, or an anchor plate to be attached to a car door, dashboard, or a wall for suspending the utility bag for use as a garbage bag.

BRIEF SUMMARY OF THE INVENTION

Reference throughout this specification to features, advantages, or similar language does not imply that all of the features and advantages that may be realized with the present invention should be, or are, in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined, in any suitable manner, in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

The present invention provides a foldable receptacle having an open mode for receiving material, a secured mode for maintaining material within the receptacle, and a storage mode. The receptacle has an obverse side, a reverse side, a pair of lateral sides, a bottom, and a closeable open top. When the closeable open top is open, the receptacle is in its open mode. In the open mode, the receptacle can accept material therein.

By closing the closeable open top, the receptacle can be closed about material to secure the material within the receptacle. When the closeable open top is secured, either permanently or temporarily, in a closed disposition, the receptacle is in its secured mode.

When folded against itself in a manner described below, the receptacle forms a pass-through pocket. The pass-through pocket can accept various types of accessories to be used in conjunction with the receptacle. The receptacle is in a storage mode when secured in the folded configuration.

A variety of fasteners can be used to secure the receptacle in either the secure mode or the storage mode. Preferably, the type of fastener used should be a releasable, reusable fastener such as a snap, Velcro®, a zip-lock fastener, a metal twist closure, or any other type of fastener that is releasable and reusable. If the fastener type is a two-part fastener such as a snap, Velcro®, zip-lock fastener, the separate parts of the two-part fastener are disposed at predetermined locations so that the separate parts align when the receptacle is folded to close and secure the top and/or to create a pass-through pocket while the receptacle is in the storage mode.

In a preferred embodiment, the foldable receptacle is transformed from an open mode to a secured mode by double folding the top. The first fold closes the top of the receptacle, and the second fold seals the top from leakage and aligns the fastener parts for fastening.

In a further preferred embodiment, the foldable receptacle is transformed from an open mode to a storage mode by multiple folds, including a double-fold of the top and sequential folds of the body of the receptacle. The first fold closes the top of the receptacle, and the second fold seals the top and positions the fastener parts for alignment and fastening. The bottom of the receptacle is folded flat adjacent either the obverse side or reverse side (whichever side accommodates alignment for fastening) of the receptacle and then folded sequentially towards the top of the receptacle until the fastener parts align. The fastener parts are then fastened to secure the receptacle in the storage mode.

By folding the receptacle in this manner, a pass-through pocket is created. This pass-through pocket may receive therein one or more accessories for use with the receptacle. This pass-through pocket facilitates specific purpose kits wherein accessories can be disposed within the pass-through pocket and the collection of one or more receptacles and accessories can be packaged as a kit.

To return the receptacle from the storage mode to the open mode, the fastened fasteners are released and the receptacle is unfolded until the top is opened for receiving material into the receptacle.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Further, reference to a "first side," "second side," "first fold," "second fold," or similar language using a numerical reference means only that the "first side" is distinct from the "second side" and the "first fold" is distinct from the "second fold," etc. In one embodiment, for example, the first side may be the obverse side of the receptacle, while in another embodiment, the first side may be the reverse side of the receptacle. Likewise, where in one embodiment the first fastener part may be the male portion of a snap fastener or the hook portion of a Velcro® fastener, for example, in another embodiment, the first fastener may be the female portion of a snap fastener or the pile portion of a Velcro® fastener.

Furthermore, the described features, structures, or characteristics may be combined in any suitable manner in one or more embodiments. In the following description, numerous specific details are provided, such as examples of fasteners, locations of fasteners, folding sequences, accessories, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Although the present invention will be described with reference to an illustrative embodiment shown in the figures and described below, those skilled in the art will appreciate that the present invention may be implemented in a number of different applications and embodiments and is not specifically limited in its application to the particular embodiment depicted herein.

These features and advantages of the present invention, as well as other features and advantages not listed, will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the foldable utility bag of the present invention, as represented in FIGS. 1 through 9, is not intended to limit the scope of the invention, as claimed, but is merely representative of presently preferred embodiments of the invention.

Figure 1:
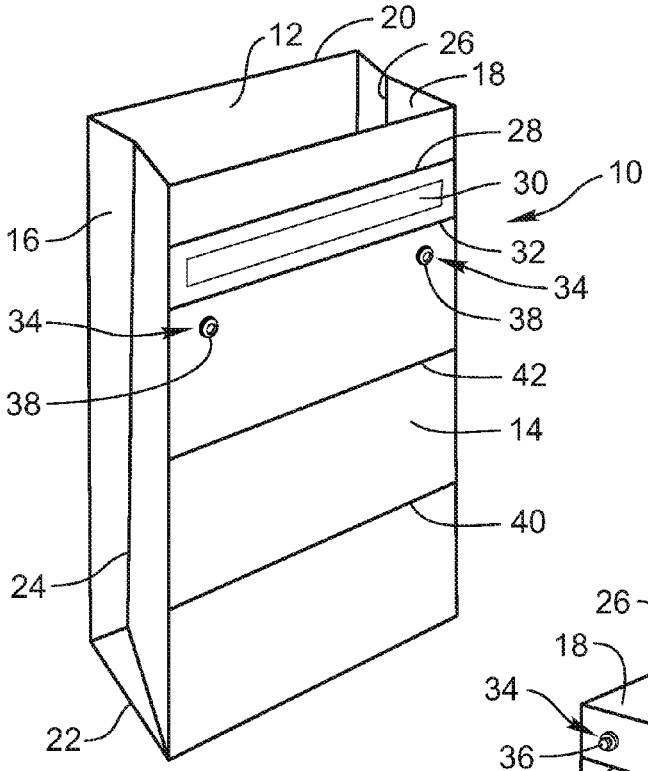
FIG. 1 is a reverse side perspective view of an open utility bag.
Figure 2:
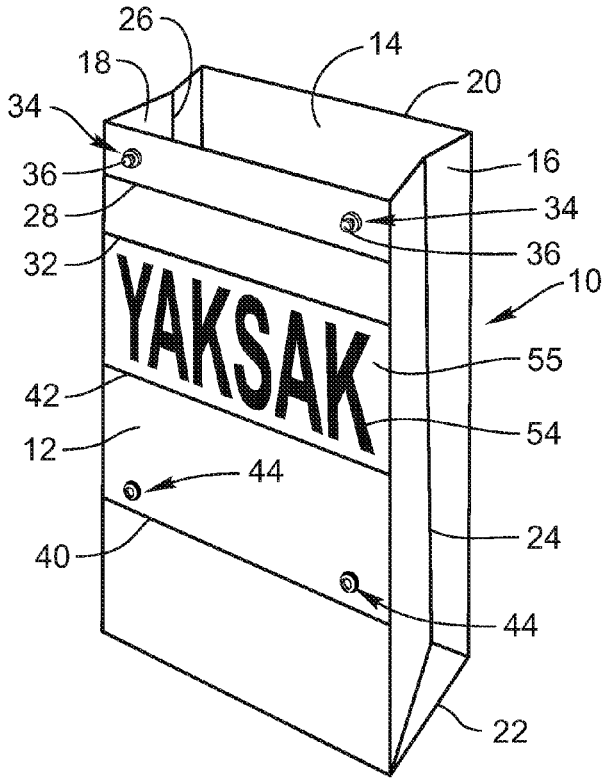
FIG. 2 is an obverse side perspective view of an open utility bag.

Referring to FIGS. 1 and 2, the utility bag of the present invention is a receptacle 10. The receptacle 10 has an obverse side 12, a reverse side 14, a pair of lateral sides 16, 18, a closable open top or mouth 20, and a bottom 22. The receptacle 10 is made of a flexible material such as impermeable paper or fabric, plastic, or any other material that can be folded or collapsed without fluids passing therethrough.

In FIGS. 1 and 2, the receptacle 10 is illustrated in its open mode where the top 20 is open and ready to receive material (not shown). The receptacle 10 is designed to receive a variety of materials such as vomit due to motion sickness or morning sickness or the flu, blood from a nosebleed, feminine hygiene products, a dirty diaper, dog excrement, sticky candy, melting ice cream, soiled tissues, garbage, or any other type of unpleasant material. More pleasant materials can also be inserted into the receptacle 10. The receptacle 10 can also be used as a sack lunch bag, an emergency ice pack, a bag to deal with hyperventilation, a sack for first aid supplies, or for any other purpose where a sealable bag could be used. Once the material is deposited into the receptacle 10, the receptacle 10 can be closed and sealed before disposing of the receptacle 10.

A number of fold lines are shown in solid line throughout the figures. These fold lines are positioned to facilitate the folding of the receptacle 10, and may or may not be printed on the receptacle 10. However, to facilitate the understanding of the invention, the fold lines are shown on the receptacle 10, in solid lines. It should be understood that different fold lines could be used when the intended purpose of the receptacle 10 might require that the receptacle be folded differently or when the receptacle might have a dimension that differs from what is illustrated. For example, a taller receptacle 10, as opposed to a shorter receptacle 10, may require an additional fold to be aligned for the storage mode.

As shown in FIGS. 1 and 2, the lateral sides 16, 18 each have an inverted-Y fold 24, 26, respectively. This inverted-Y fold 24, 26 is commonly known in the art and facilitates folding of the receptacle 10 into a flat disposition where the bottom 22 is disposed adjacent either the obverse side 12 or the reverse side 14 (see FIG. 5*b*). This inverted-Y fold configuration is typical of receptacles 10 with rectangular bottoms 22 that are capable of standing erect if the material from which it is made has sufficient rigidity. Of course, the receptacle 10 of the present invention may have a rectangular bottom 22 having a width and a depth or any other type of bottom such as a flat sealed bottom 22 (not shown) so long as the receptacle 10 can be folded to perform the functions that will be described hereinafter To close the open top 20 of receptacle 10, the receptacle 10 is folded along a closing fold 28 that is shown on the reverse side 14 in FIG. 1 and on the obverse side 12 in FIG. 2. By folding along the closing fold 28, the closable open top 20 is closed. See FIG. 3 for an illustration of the receptacle 10 as folded along the closing fold 28 line.

In one embodiment of the invention, a type of fastener is disposed below the closing fold 28 to facilitate the closing of the top 20 of the receptacle. This fastener may be one of a variety of types such as an adhesive, tabs, an integral metal twist closure, or the like. However, for the purposes of illustration, an adhesive strip 30 is shown in FIG. 1. This adhesive strip 30 can be either a sticky substance or it can be an adhesive with a protective cover strip that can be removed. When it is desired to permanently close and seal the receptacle 10, the protective cover strip can be removed and a portion of the receptacle 10 can be secured to the adhesive strip 30. If it is desired to fold the receptacle 10 into the storage mode rather than permanently seal the receptacle 10, the protective strip is not removed. Of course, the receptacle 10 need not have an adhesive strip 30 or any other type of fastener, but as an added measure of security in closing permanently the top 20 of the receptacle 10, some type of fastener is preferred.

To seal the top 20 of the receptacle 10, the receptacle 10 is again folded, i.e. double-folded, along a sealing fold 32 that is shown on the reverse side 14 in FIG. 1 and on the obverse side 12 in FIG. 2. By double-folding the top 20 of the receptacle 10 by first folding along the closing fold 28 and then along the sealing fold 32, the top 20 of the receptacle 10 is sealed such that most contents of the receptacle 10 are retained within the receptacle 10. See FIG. 4 for an illustration of the receptacle 10 as folded along the sealing fold 32 line.

In the embodiment illustrated in FIGS. 1 and 2, the adhesive strip 30 is disposed between the closing fold 28 and the sealing fold 32. Additionally, a sealing fastener is provided to secure the closure of the top 20 of the receptacle 10. This sealing fastener can be of any known type such as integral metal twist closures, adhesive strips or tabs, Velcro®, snaps, and zip-lock seals, however, it is preferred that the sealing fastener be of a releasable and reusable type such as snaps, Velcro®, or a zip lock seal. As will be described below, it is preferred that the receptacle 10 can be alternately placed in the open mode, a secured mode, and a storage mode, and having the sealing fastener be both releasable and reusable facilitates that function.

The sealing fastener shown in FIGS. 1 and 2 is a pair of snaps 34 with the male part 36 of each snap 34 disposed between the closing fold 28 and the top 20 (adjacent the top 20) on the obverse side 12 of the receptacle 10, while the female part 38 of each snap 34 is disposed below the sealing fold 32 on the reverse side 14 of the receptacle 10. In this manner, when the receptacle 10 is double-folded to seal the top 20 of the receptacle 10, the male part 36 of each snap 34 aligns with the female part 38 for secure mating engagement. When securely engaged as described, the top 20 of the receptacle 10 is secured and the receptacle 10 is in the secured mode. See FIG. 4 for an illustration of the receptacle 10 in the secured mode.

Figure 3:
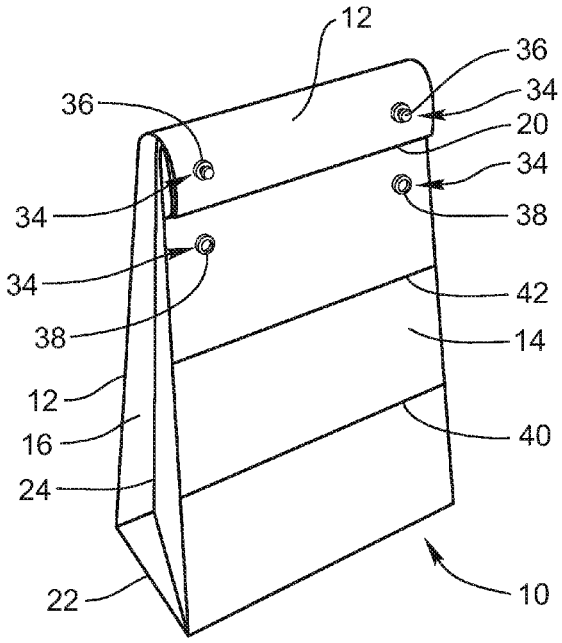
FIG. 3 is a reverse side perspective view of a utility bag showing the top of the bag folded over to close the bag.

FIG. 3 shows the receptacle 10 after the closing fold 28 has been completed. At this stage, a portion of the reverse side 14 has been folded upon itself and the male part 36 of each snap 34 is now positioned substantially parallel with the reverse side 14. If the user desires to seal the receptacle 10 permanently, the protective cover strip can be removed from the adhesive strip 30 before making the closing fold 28. By pressing the portion of the reverse side 14 against the revealed adhesive strip 30, the top 20 will remain permanently in a folded-over, closed disposition. By adhering a portion of the reverse side 14 to the revealed adhesive strip 30, the adherence will assist against any resistance that the receptacle 10 may have to remaining folded. This closed disposition will keep most contents within the receptacle 10 if the receptacle 10 is mishandled before the sealing fold 32 can be performed.

Figure 4:
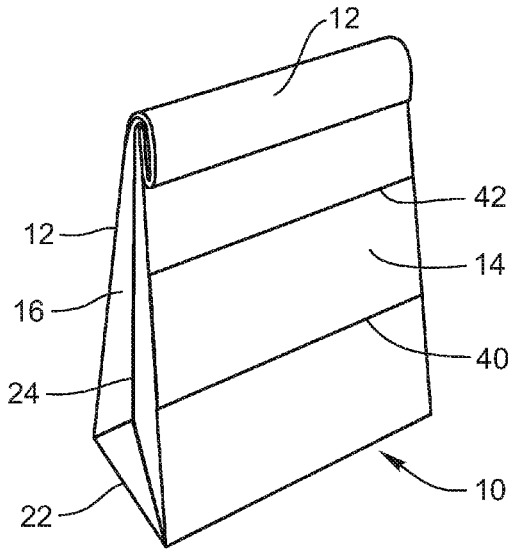
FIG. 4 is a reverse side perspective view of a utility bag showing the top of the bag double folded to seal the bag.

FIG. 4 shows the receptacle 10 in the secured mode after the sealing fold 32 has been completed and the male part 36 of each snap 34 is aligned with and connected to the female part 38 of each snap 34 in mating engagement. In the secured mode, the top 20 of the receptacle 10 is securely closed, in a double-folded fashion, preventing the escape of most materials through the top 20 of the receptacle 10. Once the receptacle 10 is in the secured mode, the receptacle 10 along with any undesirable contents disposed therein can be discarded.

Although FIGS. 1-4 illustrate a receptacle 10 that utilizes a pair of snaps 34 as the sealing fastener, it should be understood that one skilled in the art could use any number of types or combinations of fasteners to accomplish the same function. For example, the position of the male and female parts 36, 38 could be reversed or single snaps 34, rather than a pair of snaps 34, could be used. Likewise, the hook portion of a Velcro® fastener could be used on one side of the receptacle 10 while the pile portion could be positioned on the other side. Further, the male portion of a zip-lock seal could be positioned on one side while the female mating portion could be positioned on the other side.

Figure 5A:
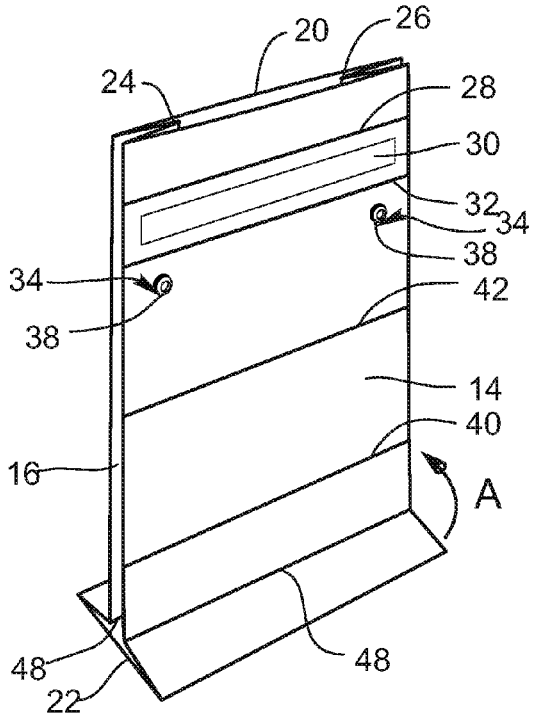
FIG. 5*a* is a reverse side perspective view of a collapsed bag showing how the bottom of the bag is folded in an initial step towards securing the utility bag in a storage mode.
Figure 5B:
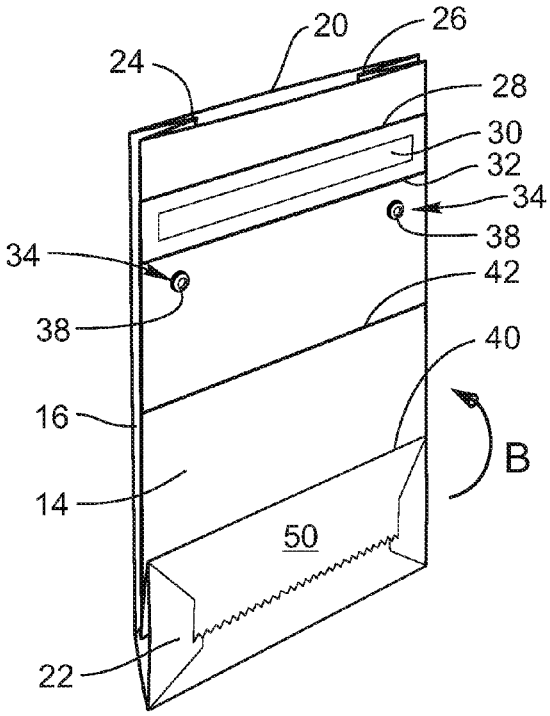
FIG. 5*b* is a reverse side perspective view of a collapsed bag showing how the bottom of the bag is folded in a subsequent step towards securing the utility bag in a storage mode.
Figure 5C:
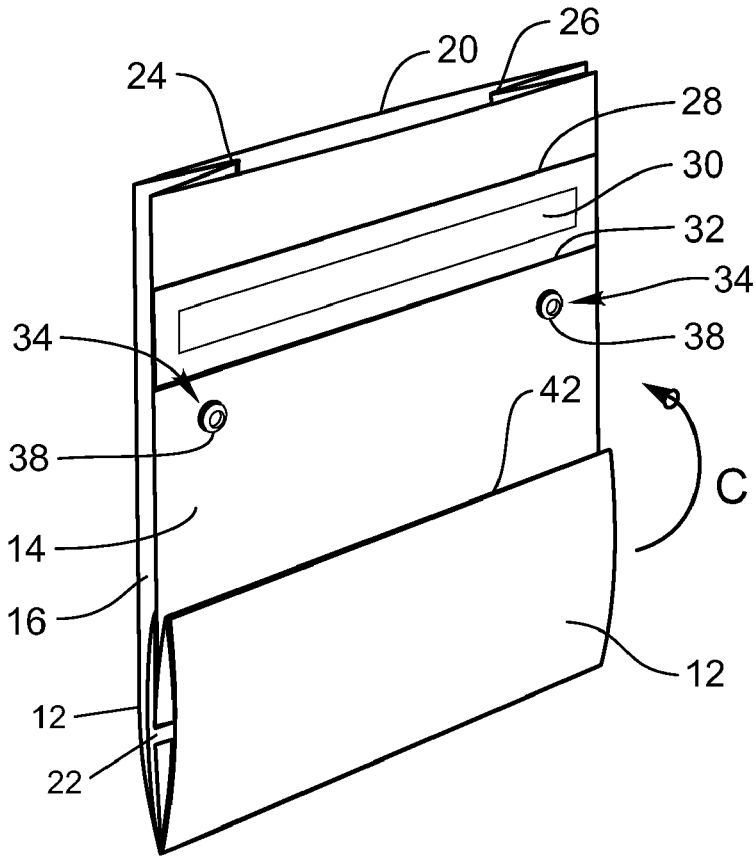
FIG. 5*c* is a reverse side perspective view of a collapsed bag showing how the partially folded bag is folded into position for securing the utility bag in a storage mode.
Figure 5D:
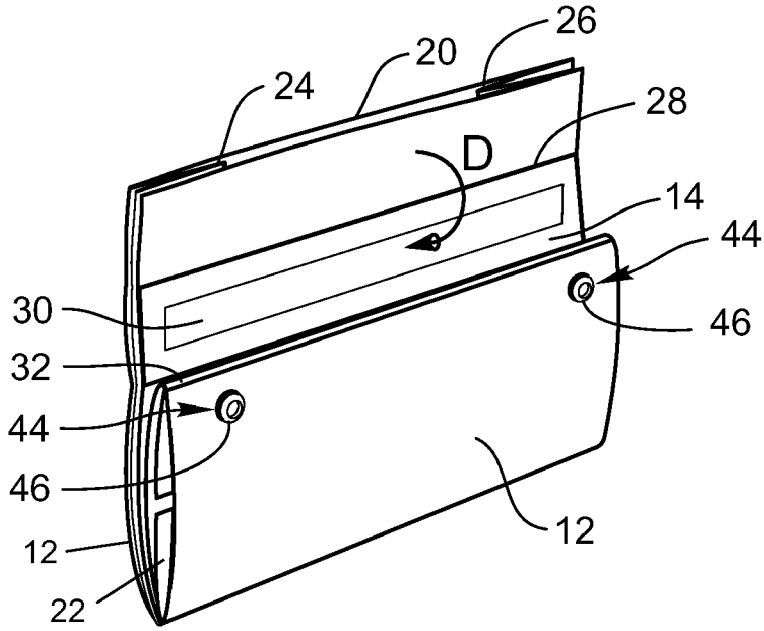
FIG. 5*d* is a reverse side perspective view of a collapsed, folded bag showing how the top of the bag is folded to close the top of the utility bag in a storage mode.
Figure 5E:
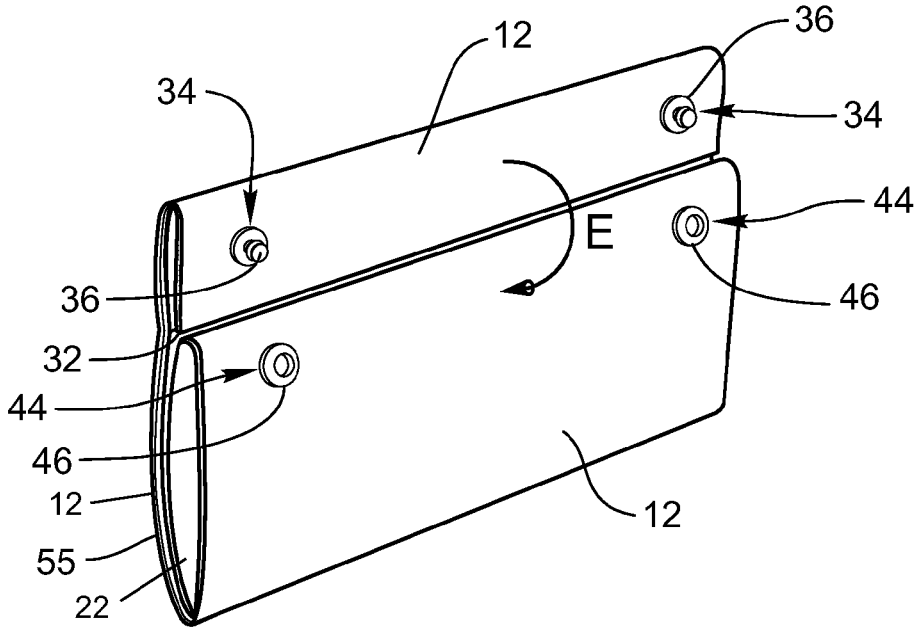
FIG. 5*e* is a reverse side perspective view of a collapsed, folded bag showing how the top of the bag is double folded into position for securing the utility bag in a storage mode.
Figure 5F:
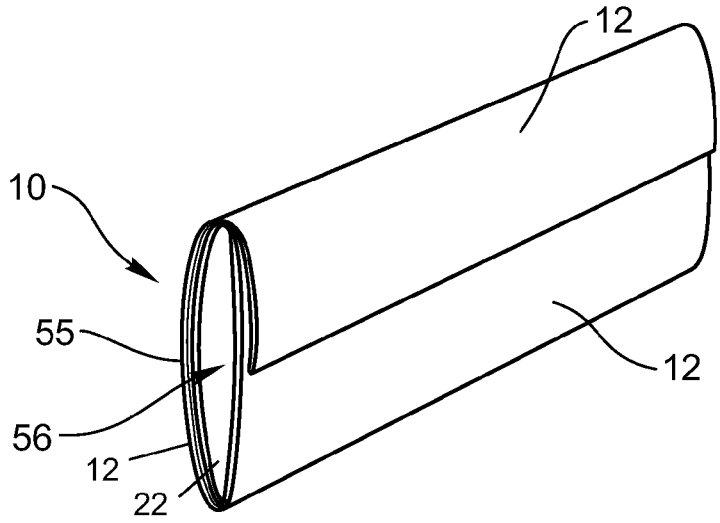
FIG. 5*f* is a perspective view of a collapsed, folded bag secured in a storage mode.
Figure 6:
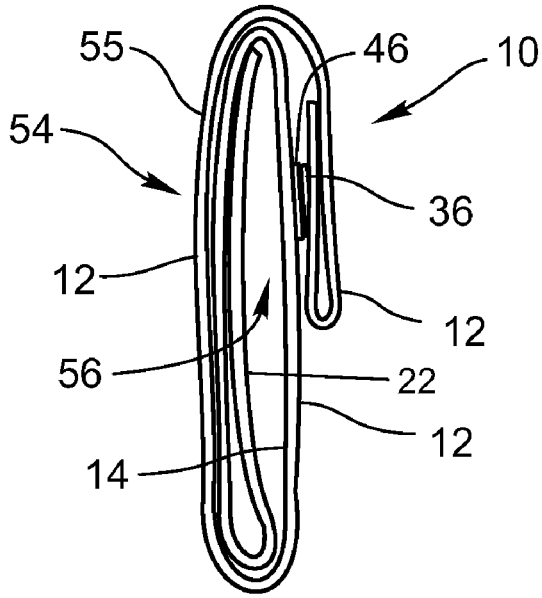
FIG. 6 is a side elevation view of a collapsed, folded bag secured in a storage mode.
Figure 7:
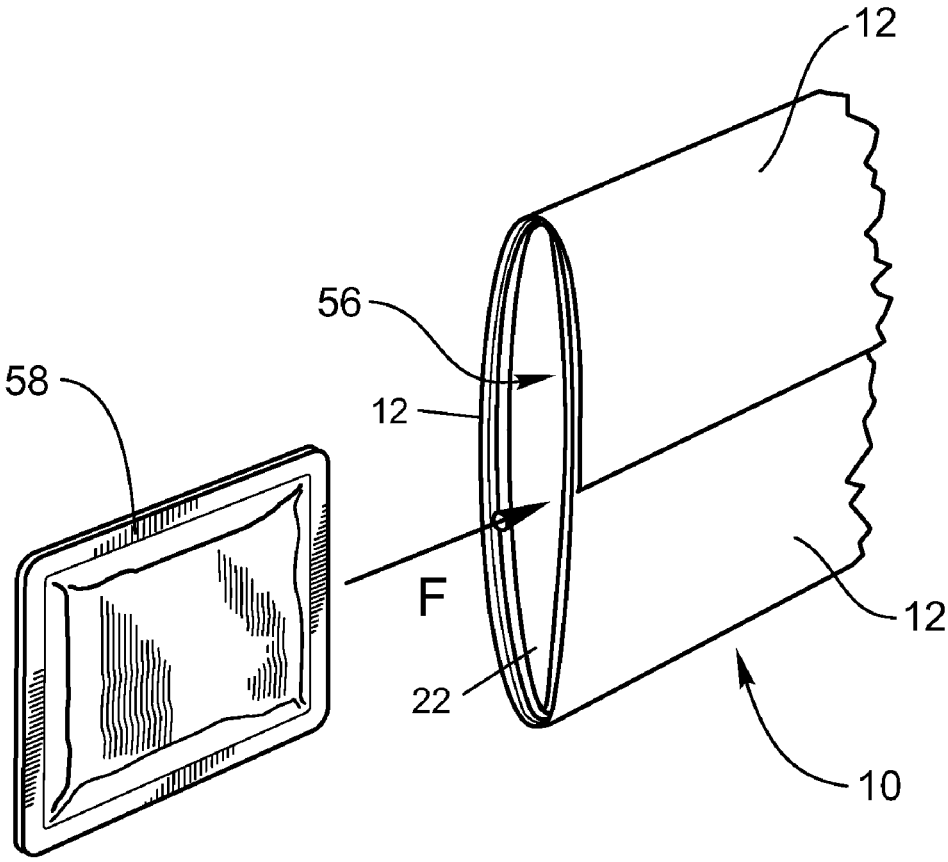
FIG. 7 is a partially broken perspective view of a collapsed, folded bag secured in a storage mode showing how the slide-through pocket formed by the folded bag can receive an accessory for storage.

FIGS. 5*a*-5*f* and 6 show the collapsing and folding of the receptacle 10 into the storage mode, and FIG. 7 shows how an accessory can be inserted into the slide-through pocket formed when the receptacle is in the storage mode.

The method for transforming the foldable receptacle 10 from an open mode to a storage mode will now be explained with reference to FIGS. 1-2 and 5-6. The receptacle 10 is shown in an open mode in FIGS. 1 and 2, which also shows a collapsed-flat fold 40 and a pocket-forming fold 42 on each of the obverse side 12 and the reverse side 14. Also shown on the obverse side 12 is an additional fastener part used to secure the receptacle 10 in the storage mode. Obviously, this additional fastener part, referred to herein as the storage fastener 44 and located from the bottom 22 a distance approximating the depth of the bottom 22 (see FIG. 2), can be any type of fastener so long as it corresponds to and cooperates with the fastener used to close and secure the receptacle 10 in its secure mode. It is preferred that the receptacle 10 can be alternately placed in the open mode, the secured mode, and the storage mode; hence, having the storage fastener 44 be both releasable and reusable facilitates that function.

In the embodiment shown, and for illustrative purposes, the storage fastener 44 is an additional female part 46 capable of receiving the male part 36 of snap 34 in secure, yet releasable and reusable, mating engagement. However, it should be understood that other fastener configurations can be used to accomplish the functions described herein. A person of ordinary skill in the art might use any number of combinations of fasteners, fastener locations or fastener parts to form a receptacle 10 capable of transformation between an open mode, a secured mode and a storage mode as described herein. Consequently, in the claims appended hereto, fastener locations, fasteners, and fastener parts are referred to with first, second, third, etc. descriptors so that the aspects of the fasteners can be distinguished one from another, yet not unduly restrict the breadth of the invention.

Turning now to FIG. 5*a*, the receptacle 10 is collapsed in preparation for folding. The inverted-Y folds 24, 26 facilitate the collapsing of the receptacle 10 in a fashion commonly known in the art. By collapsing the receptacle 10, a bottom fold 48 is introduced. This bottom fold 48 enables the bottom 22 to be folded over to align substantially parallel to the obverse and reverse sides 12, 14. Arrow A of FIG. 5*a*, shows how the bottom 22 can be folded over along the bottom fold 48 line to align the bottom 22 substantially parallel to the obverse and reverse sides 12, 14. For exemplary purposes, the receptacle 10 of FIG. 5*a* shows the collapsed receptacle 10 positioned for folding the bottom 22 against the reverse side 14. A person of ordinary skill in the art will understand that the receptacle 10, with a few minor adjustments of fasteners and fastener locations, could be folded such that the bottom 22 folds against the obverse side 12.

In FIG. 5*b*, the bottom 22 has been folded flat against and aligning substantially parallel with the reverse side 14 in preparation for another fold against the reverse side 14. Arrow B of FIG. 5*b* shows how the folded-over bottom 22 can be folded over along the collapsed-flat fold 40 line to position the exterior surface 50 of the bottom 22 adjacent the reverse side 14.

FIG. 5*c* shows the receptacle 10 with the exterior surface 50 of the bottom 22 folded adjacent the reverse side 14 in preparation for another fold wherein a exterior portion 52 of the obverse side 12 can be folded against the reverse side 14. Arrow C of FIG. 5*c* shows how the exterior portion 52 of the obverse side 12 folds over along the pocket-forming fold 42 line to position the exterior portion 52 adjacent the reverse side 14, and to bring the storage fastener 44 into position as shown in FIG. 5*d*.

With the storage fastener 44 positioned as shown in FIG. 5*d*, the top 20 of the receptacle 10 can be folded over to close the top or mouth 20 of the receptacle 10. Since the storage mode is not intended to be a permanent or final mode for the receptacle 10, the protective cover strip for the adhesive strip 30 is not removed. Of course, it should be understood that an adhesive strip 30 or any other type fastener need not be positioned as the adhesive strip 30 is shown in FIG. 5*d*; however, the adhesive strip 30 is shown for completeness of description of this embodiment of the invention. Arrow D shows how the top 20 is folded over along the closing fold 28 line to close the top 20 of the receptacle 10 and to bring the male part 36 of the snap 34 over to align substantially parallel with the reverse side 14.

FIG. 5*e* shows the receptacle 10 where the top 20 is ready to be double-folded along the sealing fold 32 line to align the male part 36 of snap 34 with the additional female part 46 of the storage fastener 44. Arrow E shows how top 20 of the receptacle 10 is folded to accomplish a double-folding to position the receptacle 10 for engagement in the storage mode. Once aligned, the male part 36 can be secured in releasable and reusable, mating engagement to the additional female part 46 as shown in FIG. 5*f*.

Of course, it makes no difference whether the bottom 22 or the top 20 of the receptacle 10 is folded over first, so long as the male part 36 of the snap 34 is brought into engaging alignment with the additional female part 46 of the storage fastener 44 for secure, yet releasable and reusable, engagement.

As illustrated in FIG. 5*f*, the receptacle 10 is in the folded storage mode. In the folded storage mode, the size of receptacle 10 is minimized to facilitate storage within a small area such as a pocket or purse. In this configuration, informational indicia 54 is located on an indicia area 55 shown on the obverse side 12 of the receptacle 10 (see FIG. 2) and positioned on the opposite side (not shown) from the side of the securing engagement. Hence, the informational indicia 54 can be prominently displayed in the indicia area 55 for advertising or instructional purposes when the receptacle 10 is in the fully folded storage mode. Additionally, when the receptacle 10 is in the folded storage mode, a slide-through pocket 56 is formed in the vicinity of the bottom 22 such that one or more accessories may be stored therein. Furthermore, the bottom 22 is disposed interior to the folded arrangement of the receptacle 10 such that the bottom 22 and the slide-through pocket 56 are each disposed between different portions of the obverse side 12 and different portions of the reverse side 14. (See also FIG. 6 for the receptacle 10 in the folded storage mode).

To return the receptacle 10 to the open mode, the male part 36 is released from the mating engagement with the additional female part 46 and the receptacle 10 is unfolded.

FIG. 6 is a side view of the receptacle 10 in the folded storage mode to better illustrate the slide-through pocket 56. Additionally, the female part 38 is not shown in FIG. 6 so not to obscure the engaging relationship between male part 36 and the additional female part 46.

Turning now to FIG. 7, a partial of the receptacle 10 is shown in a perspective view. An accessory 58 may be inserted, as shown by arrow F, into the slide-through pocket 56. Of course, any type of accessory, sufficiently small in size to be inserted into the slide-through pocket 56 may be used. For example, accessories 58 such as a moist towelette, a packet containing medication or motion sickness pills or patches, a flat doggie pooper scooper, protective gloves (such as latex gloves), facial tissues, an anchor plate (as explained below), or any other small accessory that may assist with the use of the receptacle 10 may be inserted into the slide-through pocket 56.

Figure 8:
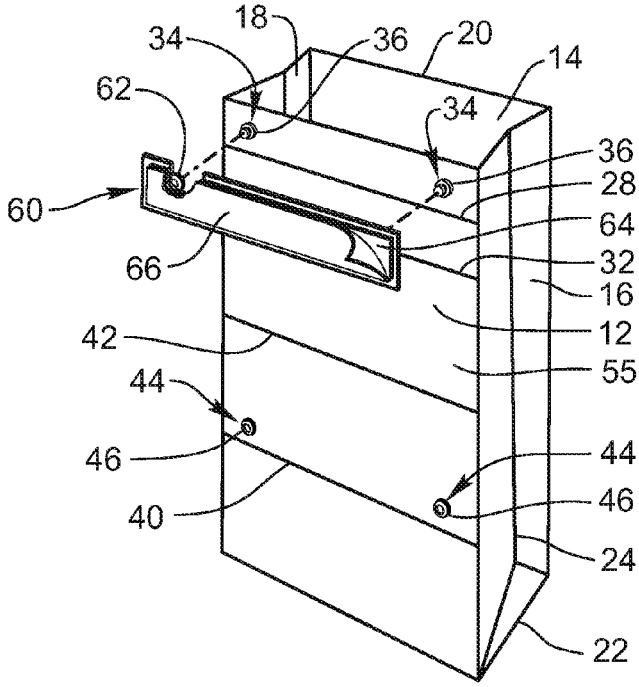
FIG. 8 is an exploded perspective view of an open utility bag illustrating an accessory used to attach the utility bag to a surface.
Figure 9:
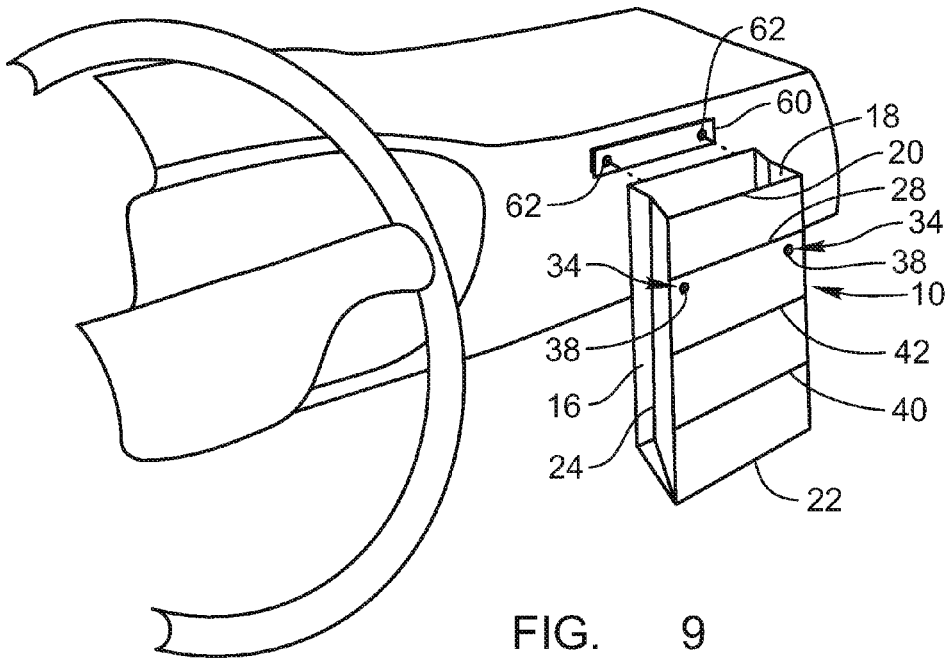
FIG. 9 is an exploded perspective view of an open utility bag illustrating how an accessory can be used to attach the utility bag to the dashboard of a car or truck for use as a garbage bag; and, FIG. 10 is a perspective view of a utility bag in the storage mode disposed within a package.

FIGS. 8 and 9 illustrate how the receptacle 10 can be anchored for use as a garbage bag. An anchor member such as an anchor plate 60 is shown with a portion cut away to show a female anchor part 62 for receiving the male part 36 of snap 34. The anchor plate 60 preferably has an anchor adhesive strip 64 attached to the side opposite from the female anchor part 62 for securing the anchor plate 60 to a surface so that the receptacle 10 can be suspended in the open mode. Of course, the anchor plate 60 need not have an anchor adhesive strip 64, but the anchor plate 60 should have some structure that facilitates the suspension of the receptacle 10 such as a hook, clip, loop or any other known anchoring structure. The anchor adhesive strip 64 has a protective cover 66 that protects the adhesive from contamination and prevents the anchor plate 60 from inadvertent connection to an undesired surface. The protective cover 66 may be removed to reveal the anchor adhesive strip 64 once the desired location for anchoring is determined.

FIG. 9 shows the anchor plate 60 secured to the dashboard of a motor vehicle so that the receptacle 10 can be suspended for use as a garbage bag. Of course, the anchor plate 60 can be secured to almost any relatively flat surface such as the side of a nightstand near a sick person or on a wall near a work bench. In this manner, once the receptacle 10 is full of garbage, the receptacle 10 can be released from the anchor plate 60 to be emptied or discarded. If discarded, a replacement receptacle 10 can be secured to and suspended from the anchor plate 60.

Figure 10:
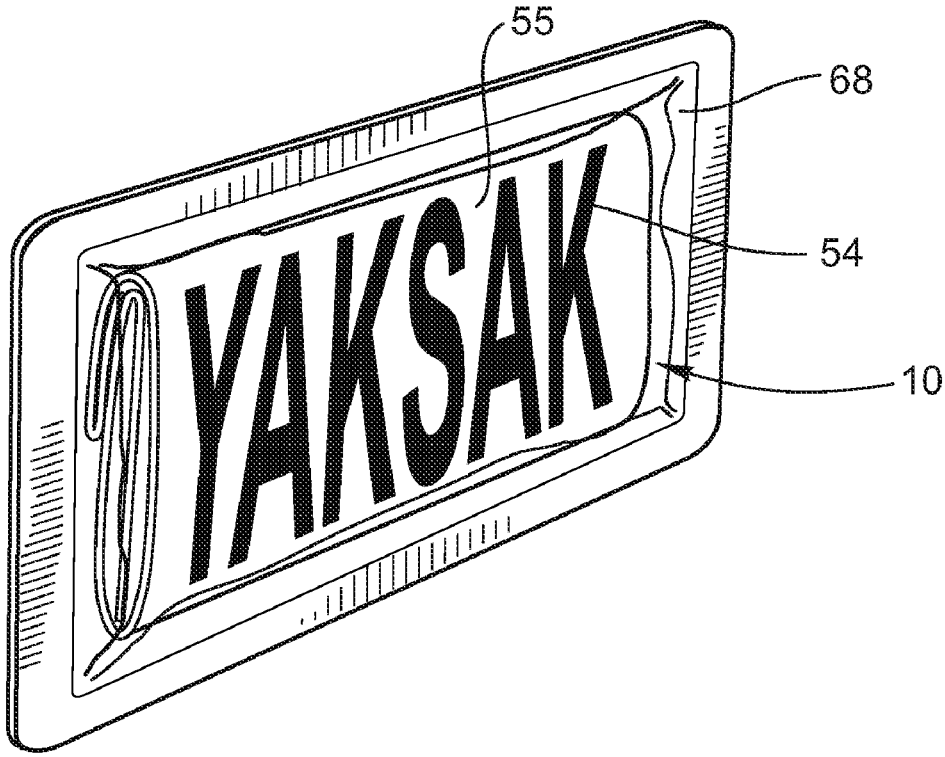

Referring now to FIG. 10, one or more receptacles 10 may be disposed within a package 68 when the receptacle 10 is in the storage mode. One or more accessories 58 may also be disposed within the package 68 (not shown). Additionally, a fragrance may be included within the package 68 and/or within the receptacle 10 that will facilitate in masking unpleasant odors frequently accompanying unpleasant materials that may be put into the receptacle 10. Of course, receptacles 10 need not be folded into the storage mode to be disposed within the package 68.

Thus, while the present invention has been fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A method for transforming a foldable receptacle from a folded storage mode to an open mode for receiving material and then to a secured mode for maintaining material, the method comprising the steps of:

providing a receptacle with a first side, a second side, a bottom having a width and a depth, and a closeable open top;

providing a first fastener part on the first side adjacent the open top;

providing a second fastener part on the second side for receiving the first fastener part in mating engagement;

providing a third fastener part on the first side and spaced from the bottom a distance approximating the depth of the bottom for aligning with the first fastener part;

providing the receptacle in the folded storage mode wherein the receptacle is folded such that the bottom is disposed between a portion of the first side and another portion of the first side and the first fastener part is in mating engagement with the third fastener part;

unfastening the first fastener part from its mating engagement with the third fastener part;

unfolding the receptacle into the open mode;

folding the receptacle along a first folding line to close the open top;

folding the receptacle along a second folding line to provide a double-fold closure of the open top of the receptacle and to align the first fastener part with the second fastener part; and securing the first fastener part in mating engagement with the second fastener part.

2. The method of claim 1, further comprising the steps of:

providing an adhesive strip disposed on the second side; and securing the adhesive strip to connect a portion of the second side to another portion of the second side.

3. A method for transforming a foldable receptacle from an open mode for receiving material to a folded storage mode, the method comprising the steps of:

providing a receptacle with a first side, a second side, a bottom having a width and a depth, and a closeable open top;

providing a first fastener part on the first side adjacent the open top;

providing a third fastener part on the first side and spaced from the bottom a distance approximating the depth of the bottom for receiving the first fastener part in mating engagement;

folding the receptacle along a first folding line to close the open top;

folding the receptacle along a plurality of folding lines sequentially such that the bottom becomes disposed between a portion of the first side and another portion of the first side to provide a pass-through pocket;

folding the receptacle along a second folding line to provide a double-fold closure of the open top of the receptacle and to align the first fastener part with the third fastener part; and securing the first fastener part in mating engagement with the third fastener part.

4. The method of claim 3, wherein the mating engagement of the first fastener part to the third fastener part is a releasable and reusable engagement.

5. The method of claim 3, further comprising the step of inserting an accessory into the pass-through pocket.

6. The method of claim 3, further comprising the step of disposing the receptacle within a package while the receptacle is in the storage mode.

7. The method of claim 6, wherein the package has a fragrance disposed within the package.

8. The method of claim 3, further comprising the step of unfastening the first fastener part from the third fastener part and the step of unfolding the receptacle such that the receptacle is restored to the open mode.

* * * * *